United States Patent [19]

Smith

[11] 4,113,400

[45] Sep. 12, 1978

[54] IMPACT RESISTANT TONGUE-AND-GROOVE COUPLING FOR HIGHWAY TRAFFIC BARRICADES

[76] Inventor: Rodney I. Smith, Rte. #1, Midland, Va. 22728

[21] Appl. No.: 788,691

[22] Filed: Apr. 18, 1977

[51] Int. Cl.[2] ..... E01F 13/00

[52] U.S. Cl. ..... 404/6; 256/13.1

[58] Field of Search ..... 404/6, 7, 8; 256/1, 256/13.1, DIG. 2; 52/582, 588, 593, 722, 726

[56] References Cited

U.S. PATENT DOCUMENTS

| | | | |
|---|---|---|---|
| 2,794,375 | 6/1957 | Falco et al. | 404/7 |
| 3,326,099 | 6/1967 | Cova et al. | 256/13.1 |
| 3,357,146 | 12/1967 | Gartrell | 52/582 |
| 3,980,279 | 9/1976 | Bofinger | 256/13.1 |

*Primary Examiner*—Henry S. Jaudon

*Attorney, Agent, or Firm*—George H. Mitchell, Jr.

[57] ABSTRACT

The vertical tongue-and-groove arrangement which is integrally molded on the ends of a concrete traffic barricade includes an impact resistant insert to protect the coupling against chipping, cracking or breaking caused by repeated use when the barricade is moved from place to place for temporary service at different locations.

17 Claims, 2 Drawing Figures

IMPACT RESISTANT TONGUE-AND-GROOVE COUPLING FOR HIGHWAY TRAFFIC BARRICADES

This application discloses and claims an improvement over the invention disclosed and claimed in my prior application Ser. No. 744,800 filed Nov. 24, 1976, now U.S. Pat. No. 4,059,362 and relates to highway median barriers and, more particularly, to the fabrication of a coupling arrangement for traffic barricades of the New Jersey style made of precast, reinforced concrete.

Barriers of this type are widely recognized by highway engineers, safety experts, and the motoring public in general, as the safest, most practical way to separate opposing traffic lanes, where a wide median is not available.

In addition, a general dissatisfaction with wooden barricades composed of 12 by 12 inch wooden beams to which upright planks are nailed, or bolted, which barricades have been used to guide traffic at construction sites has led to the use of concrete barricades for this purpose. These barricades consist essentially of a precast, reinforced concrete block having a uniform cross-section along its length so that a series of barricades can be arranged in abutting alignment to define a traffic lane.

In the preferred form, or New Jersey style, these barricades extend upwardly from the pavement a distance somewhat above the wheels of a passenger vehicle, the upper portion of the barricade being relatively thin as compared to the base of the block with the opposite side walls having only a slight taper away from the vertical in the downward direction. About half way down, they abruptly merge with a lower portion, whose opposite sides slope outwardly and downwardly at a steep angle with respect to the horizontal so that when a vehicle swerves toward the barrier, the wheels coming in contact with the lowr portion will be forcefully directed back in the opposite direction. In addition, there will be no tendency for the vehicle to climb over the barrier because of the nearly vertical slope of the upper wall surface.

While the great weight of these concrete barricades (averaging nearly 2 ½ tons per 12 foot lengths) means that it would take something more than a glancing blow of a vehicle to displace such a barricade, nevertheless, by joining adjacent sections with each other by means of a tapered tongue-and-groove arrangement, a portion of the force of any collision between a vehicle and a barricade is thus transmitted to the adjacent barricades. In other words, there is a continuity of mass with adjacent barrier sections which prevents deflection of individual sections on contact.

Barricades of this type are known, but they exhibit certain disadvantages which limits their practicality for use, particularly in the case of temporary barriers. For example, Italian Pat. No. 710,804 discloses a barricade having hooks at the ends of one barricade for engagement with a set of eyes attached to the adjacent barricades. The difficulty with such an arrangement is that horizontal disengagement of the sections is not possible. There must be a precise alignment of the adjacent sections in order for the hooks to engage with the eyes of the adjacent sections. Also, there is only a single point connection between sections which does not prevent any sort of twisting action of one barricade with respect to the next one, and comparatively little force can be transmitted between sections through the connectors. Finally, the placement of the hooks and eyes during the casting process adds to the expense of fabrication and, considering the weight of the sections, there is always a danger of bending the metal connectors during the handling of the concrete sections.

U.S. Pat. No. 3,980,279 discloses a barricade of the New Jersey type having vertical slots at both ends of one barricade to interlock with a tongue element of an adjacent barricade by vertical movement. The tongue and the slot are also formed so as to prevent release in a longitudinal direction. However, there must be precise alignment of one barricade with respect to the other when the barricade is put in place, and the molded connector portions have complex shapes which can be easily damaged during handling of the concrete sections. Expense of manufacturing would make the cost of this arrangement totally prohibitive.

U.S. Pat. No. 3,958,890 also uses a hook and eye arrangement as shown in FIG. 5, or a U-shaped joining cover 28 as shown in FIG. 6. Such an arrangement adds to the complexity of the construction, and is subject to the disadvantages of the Italian Patent design. The use of an additional element also increases cost due to the necessity of stocking the separate parts.

Norwegian Pat. No. 91,989 discloses a system in which the mating of adjacent sections takes place in an axial direction, and specially shaped inserts 1′ are employed. In a system of this type it is impossible to remove one of the barricades from a series without destroying at least one of the sections.

French Pat. No. 1,452,861 has been noted, but it is believed that this reference discloses no more than is shown in the references discussed above.

In my prior application Ser. No. 744,800, a downwardly and outwardly tapered vertical tongue is integrally molded into the end of a precast concrete barricade for engagement with a complementary groove formed in the adjacent barricade. Nevertheless, while that type of construction has proved to be eminently satisfactory in normal use, it has been found that when the barricades are used to divert traffic during road construction, and are thus frequently moved one location to another, the coupling elements may become chipped, cracked, or broken due to careless handling of the heavy barricades when being coupled together.

Thus, it is an object of the present invention to incorporate a protective cap in at least the upper portion of each of the tongues, to protect the cap, and to some extent the interfitting groove, resulting from frequently coupling and uncoupling of barricades which are used for temporary service at numerous locations.

Suitable materials from which the protective cap may be made include high impact plastics, such as nylon, ABS or polyvinyl chloride or even a material such as steel.

Other objects and advantages will be apparent to those skilled in the art after reading the following description in connection with the annexed drawings, in which.

Figure 1:
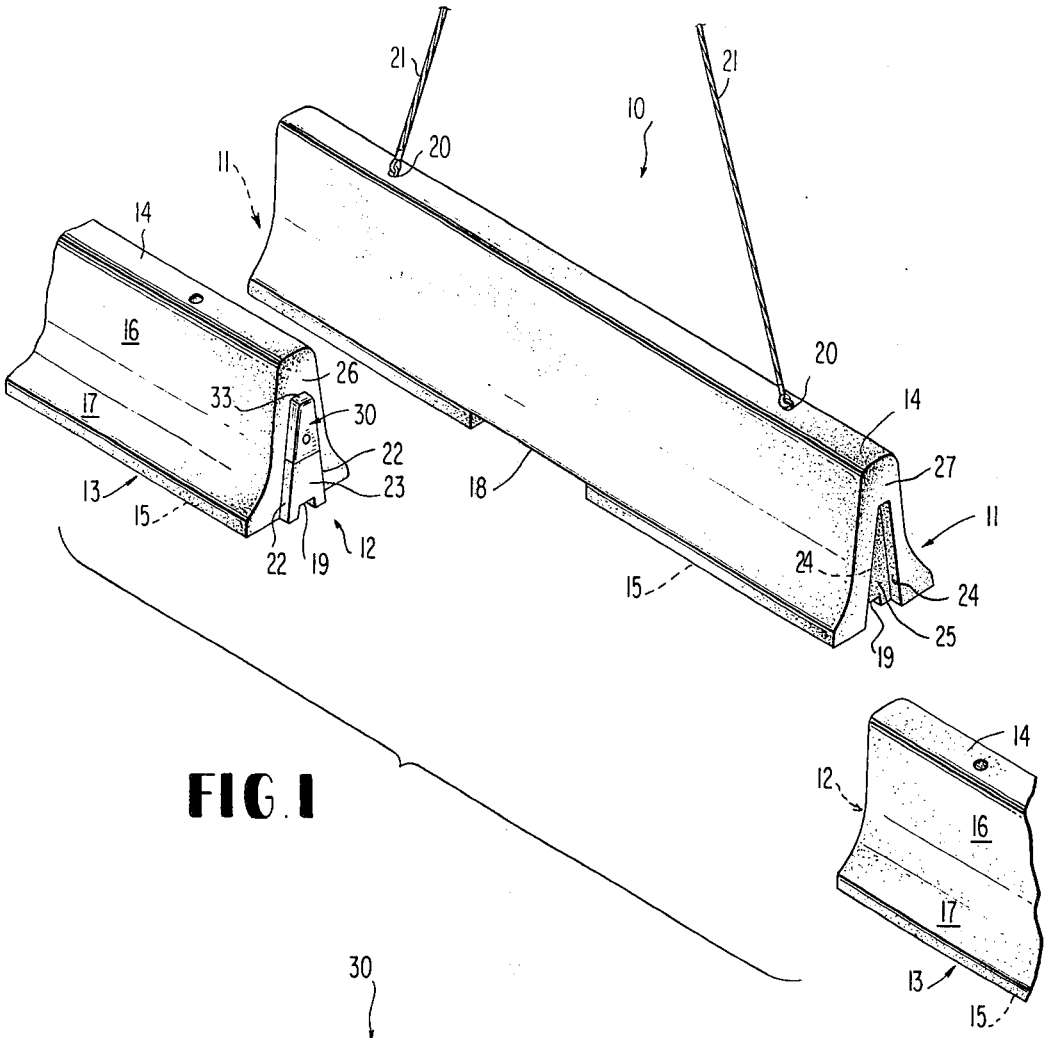
FIG. 1 is an isometric view of a section of a traffic lane barrier showing one of the present concrete barricades in a raised position between two other aligned barricades supported on the pavement or ground.
Figure 2:
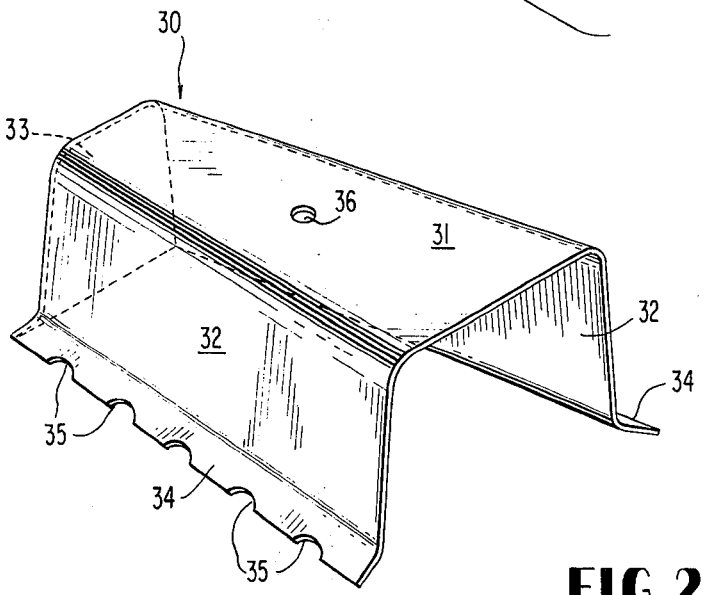
FIG. 2 is an isometric view on a greatly enlarged scale, of the protective cap provided on the tongue members of the couplings.

In FIG. 1, numeral 10 indicates generally an elongated, pre-cast, reinforced concrete barricade provided at both ends with what might be called the female part, indicated generally by numeral 11, of a two-part interengaging tongue-and-groove coupling, the male part of which coupling, indicated generally by numeral 12, is integrally formed on the end of each of the adjacent concrete barricades, indicated generally by numeral 13.

The transverse configuration of all of the barricades 10 and 13 is substantially identical so that when they are installed in end to end alignment, there are no dangerous outwardly projecting obstructions which would tear through the body of a vehicle which accidentally comes in contact with the barrier.

The configuration, which is known in the highway construction trade as the New Jersey style, consists of a top surface 14 which is relatively narrow compared with the width of the base 15. The upper side walls 16 taper outwardly at a slight angle with the vertical and are abruptly joined to the lower side walls 17 which extend downwardly at a fairly high angle with respect to the horizontal for slightly less than one half of the height of the barricade.

When the barricade is intended for use in the establishing of a temporary traffic lane, such as when vehicles are being rerouted during construction, a transverse drainage slot 18 may be provided in the base 15 midway between the ends of the barricade to prevent backup of surface water on one side or the other, and a longitudinally extending keyway 19 may also be provided in the base to assist in drainage or for use when the barricades are to be embedded in grouting, for construction of a permanent barrier between opposing lines of traffic on a completed highway. A pair of Swift-Lift inserts 20 may be embedded in the top of the barricade for detachable connection with cables 21 of a hoisting crane (not shown).

As stated above, the recess 11 and projection 12, integrally molded on the ends of barricades 10 and 13, respectively, comprise the complementary parts of a tongue-and-groove coupling between adjacent barricades, and, in order to facilitate the joining of a barricade 10 with a pair of barricades 13, which are already in place, the side walls 22 of the projecting tongue 23, and the complementary mating side walls 24 of the groove, or recess, 25 are outwardly inclined in a downward direction. Furthermore, the walls 22 are also slightly inclined inwardly as they extend horizontally away from the end wall 26, and mating walls 24 are correspondingly inclined inwardly as they extend horizontally inwardly from the end wall 27.

The advantages of the tapering of the side walls of the coupling may be judged from the fact that a typical precast concrete barricade of the type described will be about 12 feet long, 2 feet wide at the base, 2 feet 8 inches high, and will weight in the neighborhood of 4800 pounds. Thus, there are tremendous masses that must be guided into position by one or two people while suspended by a crane under the control of another person. In the present case, the mating side walls 22 and 24 are spaced apart about 2 ½ inches at their upper ends and approximately 8 inches at their lower ends, so that the barricade 10 need not be in absolute alignment with the adjacent barricades 11 as it is lowered into position. Any misalignment will be automatically corrected as the groove 25 slides downwardly on the tongue 23. Similarly, the slight horizontal taper of the mating side walls assists in the assembly if, instead of being lowered into position between a pair of barricades already in place, the barrier is being initially assembled by the successive placement of barricades into horizontal alignment with previously placed barricades. This taper also allows for placement of barricades around a normal curve often encountered in highway construction.

As stated above, it has been discovered that when barricades of this type are repeatedly shifted from one location to another there is a tendency, due to the extremely large mass involved and carelessness in handling during the final positioning of the tongue-and-groove coupling, for pieces of the tongue portion, especially the upper portion to become chipped, cracked or even completely broken off.

For this reason a protective cap, indicated by numeral 30, has been developed to cover at least the upper portion of each of the tongues. This cap is preferably molded from an impact resistant plastic, such as nylon, ABS or polyvinyl chloride in a generally box shaped form having a generally trapezoidal face 31, a pair of generally similar rectangular side walls 32, and an upper end wall 33. The free margins 34 of the side walls, and also the top wall margin, are turned outwardly at approximately 45° with respect to the remainder of the walls and may also be serrated by the provision of notches 35 to assure the proper anchoring of the cap in the concrete when it is precast. In order to position the cap in the mold prior to casting, an opening 36 may be provided in wall 31 to receive an attaching member, such as a threaded bolt for temporarily positioning the cap in the mold in a position such that when the barricade is removed from the mold the face 31 will form a continuation of the end surface 23 of the tongue and the walls 32 will form continuations of the doubly tapered side walls 22.

While three specific materials have been mentioned for use in fabricating the protective cap, it will be apparent that other materials may be used, including metallic materials, such as steel, which would come within the scope of the annexed claims.

What is claimed is:

1. In a precast reinforced concrete barricade for use in the construction of a highway lane barrier composed of a plurality of said barricades to be joined by mating tongue-and-groove couplings in endwise alignment, said barricade being elongated and having a generally symmetrical cross-section along its length, the top surface being relatively narrow compared to the width of the base, the upper portions of the side surfaces being nearly vertical, the lower side surfaces being abruptly outwardly flared at an angle to deflect a vehicle wheel away from the barricade, and at least one end wall being provided with an outwardly projecting vertical tongue, the side walls of said tongue being tapered in a downwardly and outwardly transverse direction to facilitate entrance into a complementary groove provided in an adjacent barricade in a vertical direction, the improvement which comprises at least the upper exposed portion of said tongue comprising an impact resistant material.

2. The invention defined in claim 1, wherein the other end wall of the barricade is also provided with an outwardly projecting vertical tongue similar to the first-mentioned tongue and also being provided with an impact resistant material comprising at least the upper exposed portion thereof.

3. The invention defined in claim 1, wherein the side walls of said tongue are also tapered in an outwardly and inwardly transverse direction to facilitate entrance into a complementary groove provided in an adjacent barricade in a horizontal direction.

4. The invention defined in claim 1, wherein said tongue includes a cap formed of an impact resistant material extending over the upper portions of the projecting side walls and end wall of said tongue.

5. The invention defined in claim 4, wherein the inner margings of said cap are embedded in the body of the barricade.

6. The invention defined in claim 4, wherein said cap also extends over the outwardly projecting uppermost surface of said tongue.

7. The invention defined in claim 6, wherein said impact resistant material comprises molded synthetic plastic.

8. The invention defined in claim 7, wherein said plastic comprises nylon.

9. The invention defined in claim 7, wherein said plastic comprises ABS.

10. The invention defined in claim 7, wherein said plastic comprises polyvinyl chloride.

11. Device for protecting the outwardly projecting coupling tongue integrally formed on the end wall of precast concrete barricade comprising a cap formed of impact resistant material having a top wall, downwardly outwardly tapered side walls extending from the top wall and an end wall joined to said first three mentioned walls, and means for embedding a portion of said cap in said barricade during precasting.

12. Device according to claim 11, wherein said side walls include marginal portions adapted to be embedded in the end wall of the barricade during precasting.

13. Device according to claim 12, wherein said marginal portions are disposed in planes which are angled outwardly with respect to the planes of the respective side walls.

14. Device according to claim 13, wherein the inner edges of said marginal portions are serrated.

15. Device according to claim 13, wherein said cap comprises nylon.

16. Device according to claim 13, wherein said cap comprises ABS.

17. Device according to claim 13, wherein said cap comprises polyvinyl chloride.

* * * * *